United States Patent [19]

Dugge et al.

[11] Patent Number: 4,466,558

[45] Date of Patent: Aug. 21, 1984

[54] AERATOR CONTROL ARRANGEMENT

[75] Inventors: Richard H. Dugge, St. Louis County; Dallas W. Rollins, St. Charles, both of Mo.

[73] Assignee: ACF Industries, Incorporated, New York, N.Y.

[21] Appl. No.: 407,846

[22] Filed: Aug. 2, 1982

Related U.S. Application Data

[60] Continuation of Ser. No. 32,579, Apr. 23, 1979, abandoned, which is a division of Ser. No. 545,260, Jan. 29, 1975, Pat. No. 4,165,820.

[51] Int. Cl.[3] ..... B65G 3/12

[52] U.S. Cl. ..... 222/195; 406/145

[58] Field of Search ..... 222/195, 196, 526, 527; 406/144, 145

[56] References Cited

U.S. PATENT DOCUMENTS

| | | | |
|---|---|---|---|
| 2,025,404 | 12/1935 | Stahn | 222/195 X |
| 3,318,485 | 5/1967 | Landeborg | 222/195 X |
| 3,393,832 | 7/1968 | Smith | 222/195 X |
| 3,708,209 | 1/1973 | Dugge | 222/195 X |
| 3,788,527 | 1/1974 | Matson | 222/195 |
| 3,942,689 | 3/1976 | Dakin et al. | 222/195 |
| 3,958,722 | 5/1976 | Dugge et al. | 222/195 |

*Primary Examiner*—Joseph J. Rolla

*Attorney, Agent, or Firm*—Henry W. Cummings; J. Joseph Muller

[57] ABSTRACT

A control arrangement is provided to control discharges of compressed gas to vessels containing difficult to unload material comprising one or more control valves connected in operative relation to discharge valves operative to discharge compressed gas from an accumulator. The control valves are provided with a time control circuit for controlling the time of discharge of compressed gas from the accumulator(s). This time control circuit may comprise a pneumatic, electromechanism and/or electronic timers. The control arrangement may also include an arrangement for applying pressure gas to discharge valves which are in operative relation with accumulator discharge devices which are not being utilized for unloading. Various arrangements for mounting the accumulators, discharge valves, conduits, and discharge devices are illustrated in connection with a railway hopper car. Certain discharge devices mounting arrangements are preferred in unloading certain types of lading.

12 Claims, 11 Drawing Figures

FIG. 3.A

AERATOR CONTROL ARRANGEMENT

This is a continuation of application Ser. No. 032,579, filed Apr. 23, 1979, now abandoned, which is a division of application Ser. No. 545,260, filed Jan. 29, 1975, now U.S. Pat. No. 4,165,820.

BACKGROUND OF THE INVENTION AND OBJECTS

In U.S. Pat. No. 3,788,527 issued July 30, 1974 there is disclosed a quick release aerator that stores a large volume of gas under significant pressure and then releases the gas into a storage vessel, producing a blast of gas which dislodges stuck or bridged material to be unloaded from the vessel. While this device is quite effective in dislodging and loosening clogged and/or bridged lading, it often requires a plurality of such aerators to be mounted on the vessel so that gas discharged from the aerators reaches into most, if not all parts of the vessel. Thus in many instances a large number of aerators are required for each vessel to be unloaded.

In, application Ser. No. 525,492, now U.S. Pat. No. 3,958,722 a self indexing elbow discharge device is disclosed which may be utilized with a source of high pressure gas such as an accumulator and discharge valve means for timed release of this pressurized gas. The self indexing elbow rotates upon discharge of a blast of gas from the discharge end of the elbow so that after several discharges a large volume of the storage vessel comes under action of the blast. Thus through the use of the self indexing elbow described in application Serial No. 525,492 fewer discharge valves discharge devices and associated conduits are required to dislodge bridged and/or clogged lading.

However, a problem exists as to how to control the operation of these discharge valves when a plurality of gas discharge devices are affixed to a vessel and particularly when a plurality of accumulators each having discharge valves and discharge devices in operative relation therewith. A particular example of this problem is found in connection with a railway hopper car. Most railway hopper cars comprise a plurality of hoppers, each of which is unloaded separately.

However, similar problems exist in unloading one or a plurality of static vessels including but not limited to industrial bins.

It therefore is an object of the present invention to provide an arrangement for controlling the operation of aerators utilized to facilitate unloading of difficult to unload material from vessels.

Another object of the present invention is to provide such a control arrangement which is easy to operate.

Another object of the present invention is to provide such a control arrangement which is inexpensive to manufacture.

Another object of the present invention is to provide a vessel having aerators mounted thereon and a control arrangement therefor to facilitate unloading of difficult to unload lading therefrom.

Another object of the present invention is to provide a railway hopper car having aerators mounted thereon and a control arrangement therefor to facilitate unloading of difficult to unload lading therefrom.

Another object of the present invention is to provide a control arrangement for operation of aerators mounted on a hopper car.

Another object of the present invention is to provide mounting arrangements for discharge devices which are particularly suited to certain types of ladings.

Other objects will be apparent from the following description and drawings.

THE DRAWINGS

FIG. 3A is a perspective view of the control valve assembly of the present invention;

SUMMARY OF THE INVENTION

A control arrangement is provided to control discharges of compressed gas to vessels containing difficult to unload material comprising one or more control valves connected in operative relation to discharge valves operative to discharge compressed gas from an accumulator. These control valves are provided with time control means for controlling the time of discharge of compressed gas from the accumulator(s). This time control means may comprise pneumatic electromechanical and/or electric timers. The control arrangement may also include means for applying pressure gas to discharge valves which are in operative relation with accumulator discharge devices which are not being utilized for unloading. One accumulator may service more than one discharge device if the control arrangement provides sufficient time to pressurize the accumulator after discharge from each discharge device and controls the time sequence of discharge from the various discharge devices. Various arrangements for mounting the accumulators, discharge valves, conduits, and discharge devices are illustrated in connection with a railway hopper car. Certain discharge devices mounting arrangements are preferred for unloading certain types of lading.

DETAILED DESCRIPTION

The present invention is applicable to fixed industrial bins and to many other applications wherein one or a plurality of vessels are provided generally in adjacent physical proximity, contain a difficult to unload lading. However, the present invention will be described in connection with a railway hopper car to which the control arrangement of the present invention is particularly adaptable.

Figure 2:
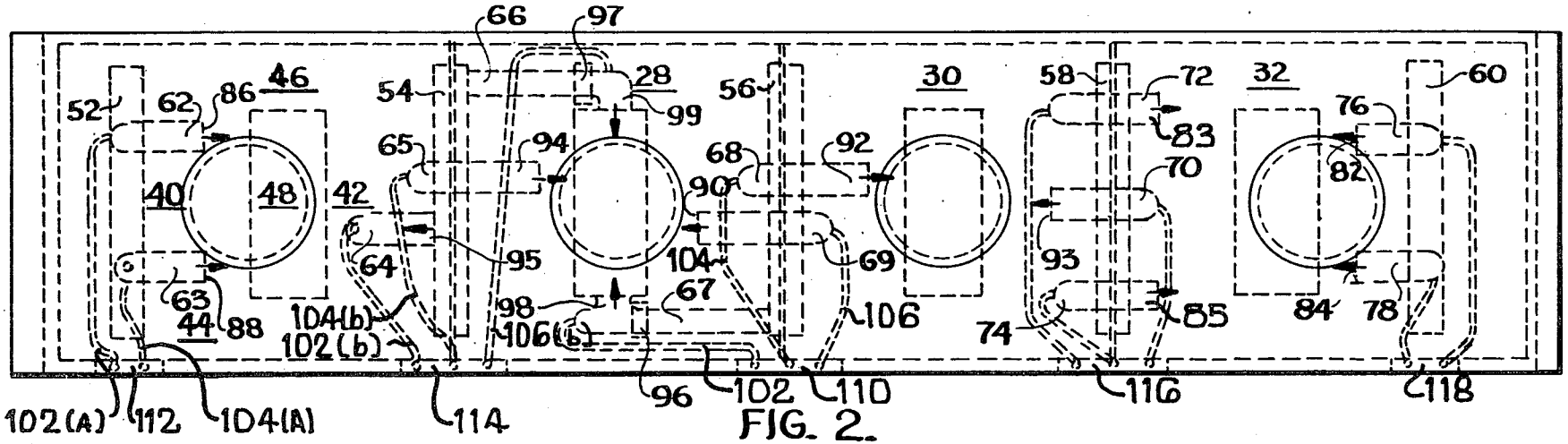
FIG. 2 is a top view of the railway car and aerators control arrangements illustrated in FIG. 1.
Figure 1:
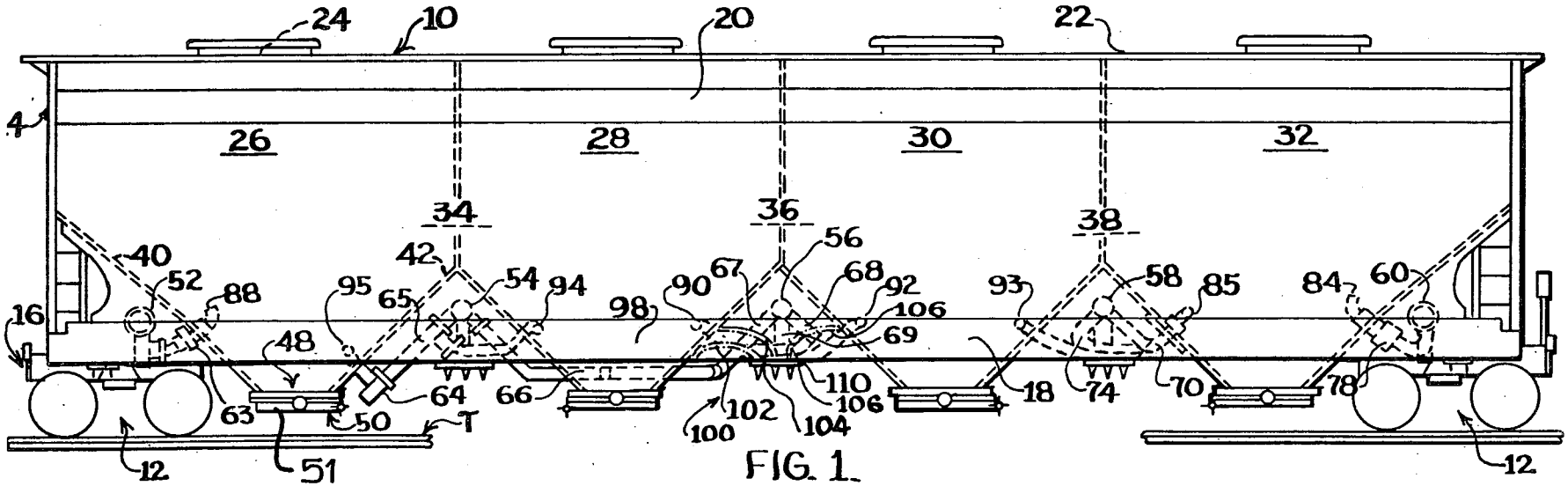
FIG. 1 is a side view of a railway car illustrating several alternative arrangements for mounting aerators thereon according to the present invention, and illustrating the aerator control arrangement of the present invention.

Therefore, in FIGS. 1 and 2 a railway hopper car is indicated generally at 10 comprising suitable trucks 12 which support the car for travel along a railway track T, conventional end support structure 14, and conventional coupler structure 16 which is known in the art. A side sill 18 and a top chord 20 carry longitudinal loads and a roof 22 is provided containing a plurality of hatch openings 24 for loading the car. The car is also provided with a plurality of hoppers 26, 28, 30 and 32. More or less hoppers may be provided on the car as desired. In the embodiment shown in FIG. 1 the hoppers are joined together by transverse bulk 34,36 and 38. Each is provided with slope sheets 40, 42, 44 and 46 which are inclined downwardly towards an outlet opening 48 which is provided with an outlet 50 which may be any of the known types such as gravity, pneumatic or gravity-pneumatic types. By way of example, a conventional gravity outlet 51 is illustrated which is movable horizontally with respect to the opening 48.

With ladings which are not difficult to unload the lading flows by gravity downwardly along the slope sheets 40, 42, 44, and 46 and is readily discharged through the outlet 50 with or without a pneumatic assist.

However, some ladings tend to clog or bridge and thus do not unload due to the force of gravity. It is necessary to provide some means for breaking up and dislodging the clogging and bridging which takes place with regard to these ladings.

As is disclosed in application Ser. No. 525,492, this may comprise one or more aerators including one or more accumulators with one or more discharge valves mounted in operative relation thereto, and one or more gas discharge devices to direct a blast of gas into the vessel or hopper. A plurality of accumulators 52, 54, 56, 58, and 60 are shown mounted below hoppers 26, 28, 30, and 32. Each of the accumulators are provided with one or more discharge valves illustrated in the drawings at 62–70, 72, 74, 76, and 78. Discharge conduits 82–86 and 86 direct the blast of gas into the hopper along the center line of the conduit longitudinally of the hoppers. Self indexing elbows as described in application Ser. No. 525,492 illustrated at 90, 92, 93 and 94 are utilized in operative relation with discharge valves 69, 68, 70 and 65 respectively. Furthermore, a manually indexing elbow is mounted in operative relation with discharge valve 64 as indicated at 95 in the drawings. It will also be apparent that the valves 96 and 97 (connected respectively to accumulators 54 and 56 by conduits 66 and 67 running along the side of the car) and discharge conduits 98 and 99 will direct a blast of air transversely of the hoppers into the outlet portion of the outlet.

A source of compressed gas is required for the operation of discharge valves 62–70, 72, 74, 76 and 78. The most convenient source to be utilized in most situations is compressed air, particularly shop air which is available at most loading and unloading sites.

It is apparent that a wide variety of aerator arrangements may be utilized on a railway hopper car or other vessel(s) which contain a lading difficult to unload. Discharge conduits which simply discharge directly into the hopper may be used. Self indexing elbow arrangements may be used. Manually rotatable elbows may be used. The blast may be applied longitudinally or transversely of the hopper.

An important feature of the present invention comprises a control arrangement for discharging a blast of gas from one or more discharge devices while avoiding the discharge of a blast of gas from selected other discharge devices.

As is described in Ser. No. 525,492 discharge valves mounted in operative relation to an accumulator are utilized to pressurize the accumulator and provide for a timed release of gas from the accumulator in the form of a blast. Thus, each of the discharge valves 62, 70, 72, 74, 76, and 78 is provided with a gas inlet to effect pressurization of the accumulators respectively in communication with the discharge valves. The control arrangement of the present invention is indicated generally at 100. Each discharge valve is provided with its own supply of compressed gas and has its own gas inlet indicated at 102. It is convenient to run the gas inlets 102, 104, 106 for a given area to a common header indicated at 110.

Figure 3:
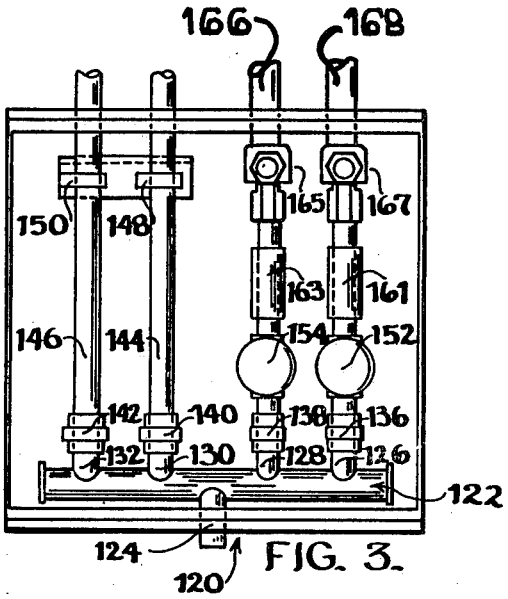
FIG. 3 is a schematic plan view of a control box which may be utilized in the aerator control system of the present invention.

It is also convenient (although not essential) to provide a control box indicated generally at 120 (FIG. 3) perferably comprising an inlet manifold 122 having a gas inlet 124 and a plurality of outlets 126, 128, 130, and 132. These outlets may be provided with suitable couplings 136, 138, and 142. Outlets 130 and 132 are provided with suitable conduits 144 and 146 which are held in place with appropriate brackets or clamps 148 and 150. Conduits 144 and 146 are adapted to be connected to respective gas inlet conduits 102, 104, 106, 108 as the occasion may arrise at header 110.

Outlets 126 and 128 are provided with control valve assemblies 152 and 154 which are utilized to cycle the accumulator discharge valves. These assemblies 152 and 154 may be provided with suitable support brackets 156 and 158. As shown in FIG. 3A, valve assemblies 152 and 154 in general comprise two elements, a control valve 160 and a timer 162. Control valve 160 may be any suitable three-way valve, being either normally closed or normally open and may be equipped with pneumatic and/or solenoid operators, for which there are many on the market. The solenoid operators may be actuated by either electronic or electro-mechanical timers.

An example of a suitable three way valve which may be utilized is an Norgren valve No. D1023B-00-Al equipped with a pneumatic operator as disclosed in the catalog entitled *Pneumatic Products* No. NC 41, copyright 1972 by C. A. Norgren Co., 5400 S. Delaware St., Littleton, Colo. 80120, page 27 thereof; or a Skinner valve New Briton, Conn. 06050 No. LP5DB5150 equipped with a solenoid operator, as shown on page 17 of the catalogue *Skinner Valves* Condensed Catalogue-VC-74 (copyright 1974).

Timer 162 may be either a pneumatic type, electromechanical or of the entirely electronic type.

In general, a pneumatic timer with about a 0–60 sec. time delay which will provide a pneumatic signal for a piloted, air actuated, 3-way valve operating in a pressure range from 20 to 150 psig, such as a Norgren No.

D1023B-00-A1-01, shown on pages 27 and 31 in the above catalog may be used.

Electro-mechanical timers usually comprise a bank of cams driven by a synchronous motor. In general, there will be one cam set for each solenoid valve with one revolution of the cam being equal to the total time cycle. An example is found in *Automatic Timing Controls Co.* catalogue No. T-100 (King of Prussia, Pa., 19406) series 2300B, dated June 1974.

In general, repeat cycle electronic timers which incorporate time setting of approx. 0–60 for both on and off conditions of the cycle may be used. The timer may have an electrical rating of either 110 volt and 50/60 HZ, 220 volt, 50/60 HZ or whatever is required to meet the given power source.

A suitable transistorized or electronic timer may be the Eagle Signal DG160A6 containing a contact rating of 10 amps. at 120 AC or 5 amps. at 240 volts AC.

A time delay relay with an adjustable time delay of approx. 0–60 sec. is used to adjust the time delay between the two continuous cycle timers. An example of such a device is an Eagle Signal CG60A6 time delay relay.

These valves and timers are commercial items and it will be apparent to those skilled in the art that a wide variety of those now on the market are suitable for this purpose.

Valve assemblies 152 and 154 are then connected by suitable couplings 161 and 163 respectively to quick release valves 165 and 167. Quick release valves 165 and 167 generally comprise a housing with a floating rubber diaphragm or piston. The piston is arranged so that when air is being supplied to the valve inlet air flow is diverted to the outlet. When air pressure is removed from the inlet, back pressure in the outlet line forces the piston back, permitting the air to be exhausted out the exhaust port. An example is a Humphrey quick exhaust valve No. QE5, found in *Humphrey Air Central Specialist;* catalog 75, (undated). Humphrey Products, P.O. Box 2008, Kalamazoo, Mich. 49003.

Quick release valves 165 and 167 drop the pressure in the respective lines from the control box to header 110 and/or the discharge valve in communication with the accumulators. While quick release valves are also provided as a part of, or integral with, the discharge valves, it has been found that the cycling is more effective, particularly where long pressure lines extend from the control box to the discharge valves, to provide quick release valves in the control box.

Figure 4:
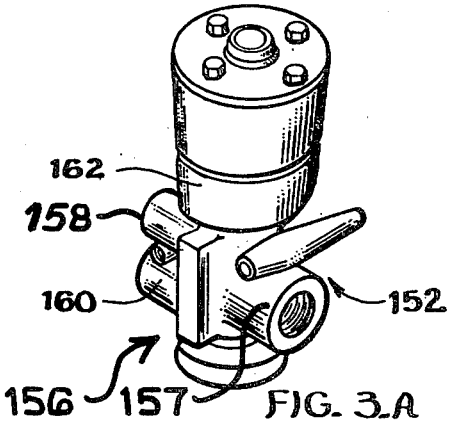
FIG. 4 is a schematic view illustrating the time discharge cycle of the aerator control arrangement of the present invention when pneumatic timer is utilized.
Figure 4:
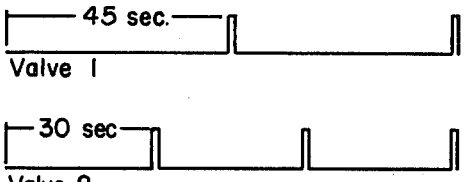

For example, accumulator 56 may be utilized for discharges. For example, if control assembly 152 is set on a 45 second cycle as shown in FIG. 4, discharge valve 69 will cause accumulator 56 to discharge through self indexing elbow 90 every 45 seconds. Similarly, control assembly 154 will cause a discharge through discharge valve 68 or elbow 92 every 30 seconds. At about the third discharge of elbow 90 and the second discharge of elbow 92 one or the other of these discharges will be significantly greater. However, the fact that one discharge is of reduced magnitude does not significantly reduce the effectiveness of the dislodging process.

Figure 5:
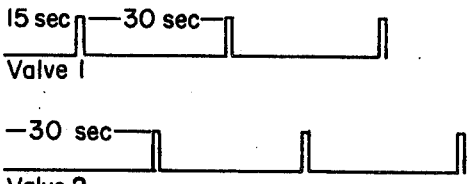
FIG. 5 is a schematic view illustrating the time discharge cycle of the aerator control arrangement of the present invention when an electronic timer is utilized.

Electronic timers have the advantage that they can be set to cycle for alternate even periods, for example, every 30 seconds. Thus, as shown in FIG. 5 control assembly 152 may be utilized to cause a discharge every 30 seconds from accumulator 52 through discharge valve 63 and conduit 88, and control assembly 154 cause a discharge every 30 seconds through valve 62 and discharge conduit 86. Thus a discharge from accumulator 52 occurs every 15 seconds.

Conduits 144 and 146 are utilized to maintain gas pressure on discharge valves connected to discharge devices in hoppers not being unloaded to prevent the accumulator from discharging through such discharge devices. For example, when hopper 28 is being unloaded and rotating elbow 90 and conduit 98 are being discharged by means of accumulator 56, one of lines 144 and 146 will be utilized to prevent the accumulator discharging rotating elbow 92 in hopper 30. The other of conduits 144 and 146 from the same or from another control box would be utilized to prevent accumulator 54 from discharging from manual elbow 95 in hopper 26 so that only rotating elbow 84 and conduit 99 would discharge.

Preferably, when, for example, hopper 28 is being unloaded both accumulators 54 and 56 are utilized and discharges are occuring through rotating elbow 90 and conduit 98 from accumulator 56, and from rotating elbow 94 and conduit 99 from accumulator 54. Accumulators 54 and 52 would be utilized to unload hopper 26 to provide discharge respectively from manually rotatable elbow 95 and discharge conduits 86 and 88. Accumulators 56 and 58 would be utilized to unload hopper 30, and accumulators 56 and 60 would be utilized to unload hopper 32.

It will be apparent that it will require one or two control boxes to control the discharge from a given hopper, depending on the number of discharge devices per hopper and the number of control assemblies and pressure conduits of the type of 144 and 146 per control box. This may vary as desired and as is convenient for particular unloading site arrangements. If in certain instances it is desired to unload more than one hopper at a time, then more control assemblies and pressure conduits would be required to unload two hoppers simultaneously.

It will be apparent that for static bin applications whether one or more control boxes will be required will depend upon the number of control assemblies and pressure lines per control box and where and how many discharge devices are mounted on the bins.

Figure 6:
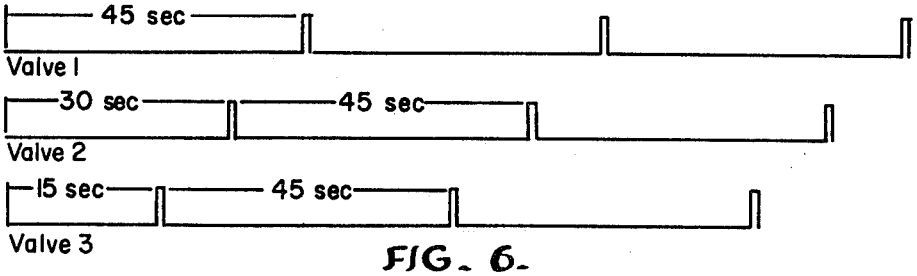
FIG. 6 is a schematic view illustrating the time discharge cycle of the aerator control arrangement of the present invention illustrating cycling three discharge devices per accumulator.
Figure 7:
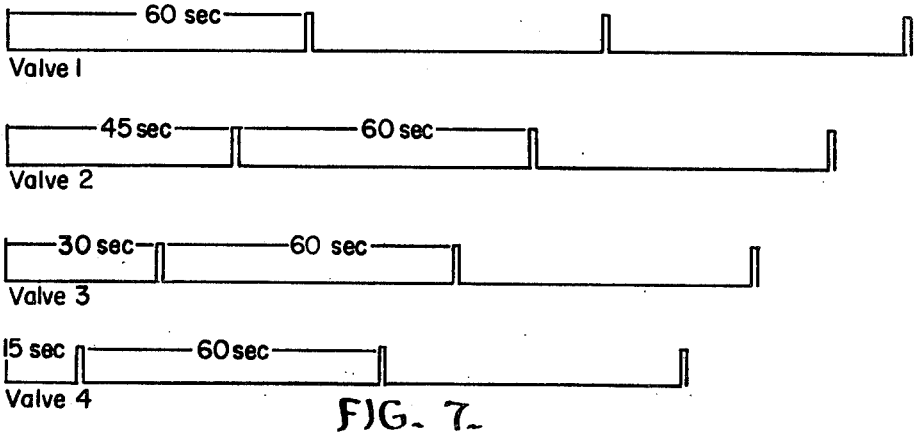
FIG. 7 is a schematic view illustrating the time discharge cycle of the aerator control arrangement of the present invention illustrating cycling four discharge devices per accumulator.

It is within the scope of the present invention to provide cycling for more than two discharges for a given accumulator. Thus, in FIGS. 6 and 7, three and four member discharge cycles per accumulator are shown by way of example.

It will also be apparent that the control arrangement of the present invention could be utilized to allow cycling of one discharge member and block discharge from one or more discharge valves. The control assembly of the present invention may be provided with as many pressure conduits as desired and as many control assemblies as desired so long as appropriate cycling patterns are utilized for the associated assumulators and discharge valves.

In accordance with the present invention it has been found that it is advantageous to place certain discharge devices in certain locations to facilitate the unloading of certain lading. For example, for unloading a particulate material which fluidizes at least to some extent in the lower hopper cavity, near the outlet, it is preferred to provide a self indexing elbow on at least one and perferably both slope sheets, perferably about one-third to two-thirds of the way up the sloping portion of the slope sheet. See, for example, self indexing elbows 92 and 93 in hopper 30 in FIGS. 1 and 2.

This arrangement is utilized for materials (usually powders) which have a very low flowability but are affected to some degree by fluidization. Examples of such materials include wood flour, precipitated calcium cloride, clay, talc, diatomaceous earth and plastic plasticizers. These materials exhibit severe bridging tendencies. However, fluidization will normally permit a void to develop directly over the outlet or in the bottom of the hopper. For this condition the pressures exerted by the blasters will cause material to collapse into the void. The self rotating feature of the elbow will cause the blast to be diverted to substantially all portions of the slope sheet which will knock down material hung-up on the slope sheet or in the valley angles (junction of side and transverse slope sheets).

In handling a granular material not significantly affected by fluidization it is preferred to provide at least one manual elbow low down on the slope sheet (on the lower third of the slope sheet) which can be aimed at the outlet. Note manual elbow 95 in the lower portion of hopper 26. Perferably one such manual elbow is provided on each slope sheet.

This arrangement is used for ladings which are usually granular and are not affected by fluidization. Examples include film scrap, crumb rubber, polyvinyl chloride pellets and wood chips. Because of their geometric shape the particles interlock, permitting the lading to develop a large shearing stress, which often results in severe bridging directly over the outlet discharge opening. A manual elbow is used so that the blast can be repeatedly directed down toward the outlet discharge opening until the lading beneath the elbow is blasted away. The elbow may then be rotated to direct the blast up at the bottom surface of the arch which will permit material to be blasted away until the bridge collapses.

Figure 8B:
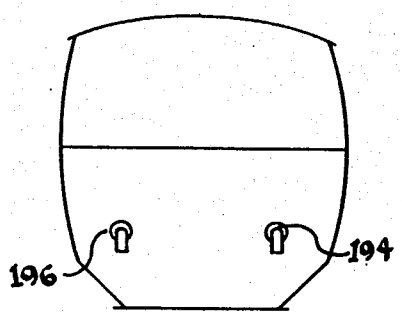
FIG. 8B is a sectional view along the lines 8B—8B in FIG. 8.
Figure 8:
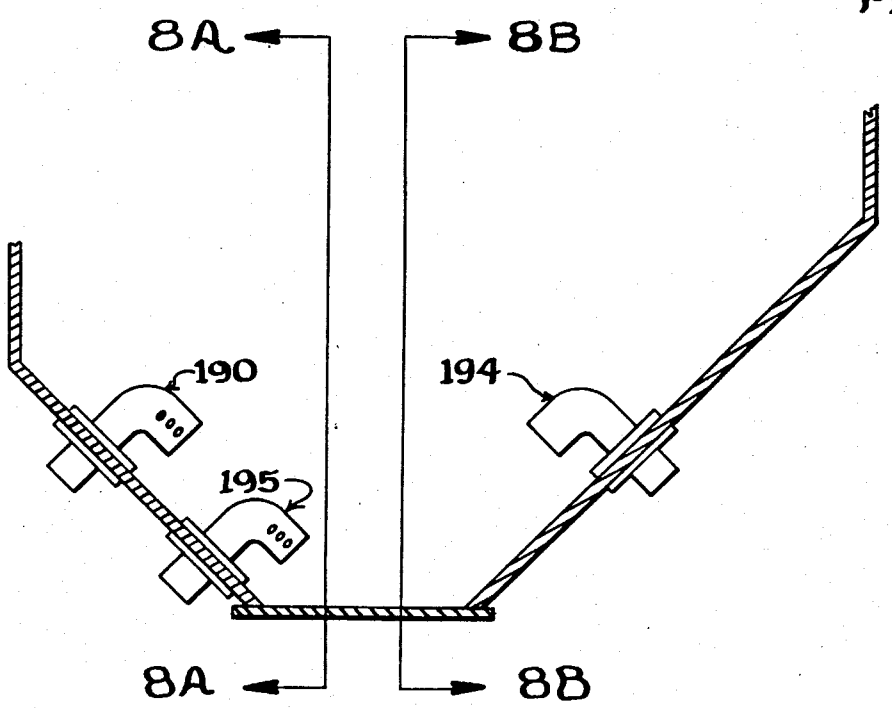
FIG. 8 is a transverse sectional view of a hopper illustrating a discharge device mounting arrangement for a particularly difficult to unload type of lading.
Figure 8A:
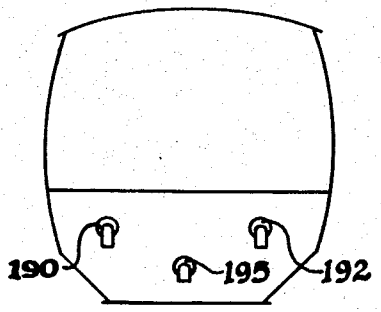
FIG. 8A is a sectional view along the lines 8A—8A in FIG. 8.

Furthermore, for very difficult unloading materials which bridge both low down in the hopper and high in the hopper, and tend to cling to the side of the car, it is preferred to provide a manual elbow 195 on the lower portion (lower $\frac{1}{3}$) of the slope sheet near the outlet and at least one and preferably two self rotating elbows (190 and 192) on the upper portion (upper $\frac{1}{2}$) of one of the slope sheets adjacent the outlet, as shown in FIGS. 8, 8A and 8B. Most preferably, at least one and preferably two are provided in the upper portion of each slope sheet. Note self rotating elbows 194 and 196 in FIG. 8B.

This arrangement is utilized for extremely difficult material, usually fibrous (examples of which are asbestos and some grades of wood flour) which exhibit severe arching tendencies, severe hang-up in valley angles and will bridge the discharge opening even in the loose or non-compacted state.

The manual elbow is directed down at the discharge opening to precent lading from bridging the opening. It may also be rotated toward the lower part of the valleys. The self rotating elbows will dislodge the material which will hang-up on the transverse floor sheets, side slope sheets and the valley angles.

The embodiments of the invention in which an exclusive property or privilege is claimed are defined as follows:

1. A railway hopper car comprising: a plurality of hoppers spaced longitudinally along said car; each of said hoppers having slope sheets at the lower portion thereof extending downwardly to define a discharge opening; a discharge outlet mounted so as to be movable between open and closed positions relative to said discharge opening; each of said hoppers adapted to contain a particulate granular lading not significantly affected by fluidization, which when loading into said hoppers results in severe bridging directly above said outlet; at least one gas accumulator mounted upon said car; means for periodically pressurizing said accumulator; at least one selectively positionable manually rotatable elbow mounted upon at least one of said slope sheets on the lower portion thereof adjacent said outlet; means for periodically discharging said accumulator; means for directing blasts of gas from said accumulator through said manually rotatable elbow toward selective positions adjacent the outlet until bridged lading adjacent the outlet is rendered flowable and flows through said discharge opening, and whereby said manual elbow may then be rotated to direct blasts of gas to other portions of the hopper to break up additional bridged lading.

2. A railway hopper car according to claim 1 wherein another manual elbow is provided on the lower portion of a different hopper slope sheet adjacent said outlet.

3. A railway hopper car according to claim 1 wherein said manually rotatable elbow is mounted on a transverse hopper slope sheet.

4. A railway hopper car comprising: a plurality of hoppers spaced longitudinally along said car; each of said hoppers having slope sheets at the lower portion thereof extending downwardly to define a discharge opening; a discharge outlet mounted so as to be movable between open and closed positions relative to said discharge opening; said hoppers adapted to contain a particulate lading having low flowability and having a strong tendency to bridge across said hopper slope sheets but which lading is fluidizable to an extent sufficient to form a void above said outlet upon fluidization; means for fluidizing the lading in said hoppers; at least one gas accumulator mounted upon said car; means for periodically pressurizing said accumulator; at least one self-rotating substantially rigid elbow mounted upon at least one of said slope sheets above said outlet generally in the area where said void normally terminates in said hopper and means for periodically discharging said accumulator whereby during fluidized unloading said self-rotating elbow will cause a blast of gas to be directed in varying known and predictable directions along the slope sheet upon which it is mounted, and will thereby break up material bridged across said slope sheets at a level in said hopper generally above said void and allow such material to flow out of said discharge opening during unloading.

5. A railway hopper car according to claim 4 wherein said self-rotating elbow is mounted upon said slope sheet between one-third ($\frac{1}{3}$) and two-thirds ($\frac{2}{3}$) of the distance up the sloping portion of said slope sheet.

6. A railway hopper car according to claim 5 wherein another self-rotating elbow is mounted upon a second slope sheet generally in the area where said void normally terminates in said hopper.

7. A railway hopper car comprising:

a plurality of hoppers spaced longitudinally along said car; each of said hoppers having slope sheets extending downwardly at the lower portion thereof to define a discharge opening; a discharge outlet mounted so as to be movable between open and closed positions relative to said discharge opening; said hopper adapted to contain a very difficult to unload lading which has a strong tendency to bridge and hang up both in the lower portion of the hopper adjacent the outlet, and in the upper portion of the slope sheet portion of the hopper; at least one selectively positionable manually rotatable elbow mounted upon the lower portion of at least one of said hopper slope sheets adjacent said outlet; and being in fluid communication with at least one gas accumulator mounted upon said car; and at least one substantially rigid self-rotating elbow mounted on the upper portion of at least one of said hopper slope sheets in fluid communication with at least one gas accumulator mounted upon said car; means for periodically pressurizing said accumulator; means for periodically discharging said accumulator; whereby said manually rotatable elbow may be used to direct blasts of gas into the area adjacent said outlet to break up bridged lading immediately above said outlet and in the lower portion of said hopper, and whereby said self-rotating elbow may be used to break up bridged lading in portions of said hopper above said manual rotatable elbow.

8. A railway hopper car according to claim 7 wherein another manually rotatable elbow is located on the lower portion of another of said hopper slope sheets adjacent said outlet.

9. A railway hopper car according to claim 7 wherein another self-rotating elbow is located on the upper portion of another hopper slope sheet in said hopper.

10. A railway hopper car according to claim 7 wherein said manually rotatable elbow and said self-rotating elbow are both located on transversely extending hopper slope sheets.

11. A railway hopper car comprising: a plurality of hoppers spaced longitudinally along said car; each of said hoppers having slope sheets at the lower portion thereof extending downwardly to define a discharge opening; a discharge outlet mounted so as to be movable between open and closed positions relative to said discharge opening; said hoppers adapted to contain a particulate lading having low flowability and having a strong tendency to bridge across said hopper slope sheets but which lading is fluidizable to an extent sufficient to form a void above said outlet upon fluidization; means for fluidizing said lading in said hoppers; at least one gas accumulator mounted upon said car; means for periodically pressurizing said accumulator; means for periodically discharging said accumulator; at least one substantially rigid self-rotating elbow mounted upon at least one of said slope sheets above said outlet generally about one-third to two-thirds of the way up the sloping portion of the slope sheet and whereby during fluidized unloading said self-rotating elbow will cause a blast of gas to be directed in varying known and predictable directions along the slope sheet upon which it is mounted, and will thereby break up material bridged across said slope sheets at a level in said hopper generally above said void and allow such material to flow out of said discharge opening during unloading.

12. A railway hopper car according to claim 11, wherein another self-rotating elbow is mounted upon a second slope sheet between one-third ($\frac{1}{3}$) and two-thirds ($\frac{2}{3}$) of the distance up the sloping portion of said slope sheet.

* * * * *